US010797454B1

(12) United States Patent
Lin et al.

(10) Patent No.: US 10,797,454 B1
(45) Date of Patent: Oct. 6, 2020

(54) LOSS PREVENTION STRUCTURE FOR ADAPTER

(71) Applicant: Elka International Ltd, New Taipei (TW)

(72) Inventors: Kai-Hsuan Lin, New Taipei (TW); Yi-Chieh Cheng, New Taipei (TW); You-Yuan Deng, Dongguan (CN)

(73) Assignee: ELKA INTERNATIONAL LTD, New Taipei (TW)

( * ) Notice: Subject to any disclaimer, the term of this patent is extended or adjusted under 35 U.S.C. 154(b) by 0 days.

(21) Appl. No.: 16/525,532

(22) Filed: Jul. 29, 2019

(51) Int. Cl.
*H01R 31/06* (2006.01)
*E05B 73/00* (2006.01)

(52) U.S. Cl.
CPC ..... *H01R 31/06* (2013.01); *E05B 73/0005* (2013.01)

(58) Field of Classification Search
CPC ..... H01R 31/06; H01R 13/60; H01R 13/62; H01R 13/627; H01R 13/6275; H01R 13/639; H01R 4/38; H01R 4/42; H01R 11/00; H01R 11/03; H01R 11/05; H01R 43/00; E05B 73/0005
See application file for complete search history.

(56) References Cited

U.S. PATENT DOCUMENTS

| | | | | |
|---|---|---|---|---|
| 9,784,338 | B1 * | 10/2017 | Parrett | F16G 11/10 |
| 10,132,105 | B1 * | 11/2018 | Hawkins | H02G 1/00 |
| 10,587,075 | B1 * | 3/2020 | Lin | H01R 31/06 |
| 2005/0134214 | A1 * | 6/2005 | Geiger | H01R 31/06 320/111 |
| 2012/0252261 | A1 * | 10/2012 | Wu | H01R 31/005 439/501 |
| 2012/0252277 | A1 * | 10/2012 | Wu | H01R 24/62 439/638 |
| 2017/0058569 | A1 * | 3/2017 | Liu | E05B 73/0005 |

* cited by examiner

*Primary Examiner* — Oscar C Jiminez
(74) *Attorney, Agent, or Firm* — Chun-Ming Shih

(57) ABSTRACT

A loss prevention structure for an adapter, that includes: a plurality of adapters, and a latch fastening seat. Wherein, each adapter has a flexible latch lock piece connected to a side of the adapter, the latch lock piece has a movable end and a latch buckle at a tail portion of the latch lock piece. The latch fastening seat is formed by two opposite indent plates, and a plurality of connection elements. A jacket hole is formed by an indent portion between the two indent plates, to hold on to a connection cable or a fixing rod. In the latch fastening seat is disposed at least a fastening portion, and the fastening portion is provided with at least a penetrating portion leading to outside.

6 Claims, 5 Drawing Sheets

LOSS PREVENTION STRUCTURE FOR ADAPTER

BACKGROUND OF THE INVENTION

Field of the Invention

The present invention relates to a structure used for an adapter, and in particular to a loss prevention structure for adapter.

The Prior Arts

Nowadays, due to the widespread and increasing use of Internet, people usually use 3 C products, such as handsets, notebook computers, to send and receive e-mail and to gather information easily and conveniently. As such, the 3C products play an important role in our daily life. In this respect, the price of new generation of 3C product tends to be high, and since it is of light weight and compact size, it is liable to be stolen and taken away easily in an Exhibition. Therefore, presently on the market, quite a lot of anti-theft locks and chains are available, to prevent 3C products from being stolen.

In addition, a lot of high-end connectors and adapters are available on the market and are often placed in an Exhibition for display and sales promotion. Due to the enormous crowd on sight, the connectors and adapters can be stolen and taken away easily, to cause losses and damages to the vendors. Even worse, this may cause supply shortage of 3C products, to adversely affect the normal operations of an Exhibition.

For the conventional anti-theft connector head, on an adapter is provided with a hole, for a ring-shape rope body to penetrate through. And a fastening sleeve tube is disposed on the rope body, to be fixed onto a fix position of the adapter, to restrict the adapter connected to move only in a range of the length of the ring-shape rope body, to prevent theft from happening. However, this type of structure is rather too simple, the anti-theft function is not sufficient, thus the adapter can easily be broken, to cause damage and loss to its user.

Therefore, presently, the design and performance of the anti-theft connector head is not quite satisfactory, and it leaves much room for improvements.

SUMMARY OF THE INVENTION

In view of the problems and drawbacks of the prior art, the present invention provides a loss prevention structure for an adapter, that is novel in design, and easy to operate.

The present invention provides a loss prevention structure for an adapter, comprising: a plurality of adapters, and a latch fastening seat. Wherein, each adapter has a flexible latch lock piece connected to a side of the adapter, the latch lock piece has a movable end and a latch buckle at a tail portion of the latch lock piece. The latch fastening seat is formed by two opposite indent plates, and a plurality of connection elements. A jacket hole is formed by an indent portion between the two indent plates, to hold on to a connection cable or a fixing rod. In the latch fastening seat is disposed at least a fastening portion, and the fastening portion is provided with at least a penetrating portion leading to outside.

When the two indent plates of the latch fastening seat is made to open, that will bring the fastening portion to open accordingly, to allow the adapter and the latch buckle of the latch lock piece to be placed in. When the two indent plates of the latch fastening seat is made to close, that will bring the fastening portion to close accordingly, to lock and fix the adapter and the latch buckle of the latch lock piece into the fastening portion of the latch fastening seat.

Compared with the existing technology, the present invention has the advantages that, it can be used to gather and protect the plurality of adapters connected to the latch fastening seat, so that the range of movement of the adapters is limited by the length of the latch lock piece. In this way, the present invention is able to protect the adapter from being lost, to prevent the latch fastening seat from being opened, and the adapters being taken away easily, in achieving the objective of preventing the loss or theft of the adapters.

In addition, through the design of the present invention, a plurality of adapters can be attached to the same latch fastening seat to be sold conveniently. As such, the adapters can be replaced by various types of adapters at any time. When the adapter is inserted into the connector connected to the connection cable, it could satisfy the needs of the various 3C products. The output of the adapters can be connected to the peripheral equipment of the prevalent technology, such as liquid crystal screen, projector, and stereo surround sound device.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

Figure 1:
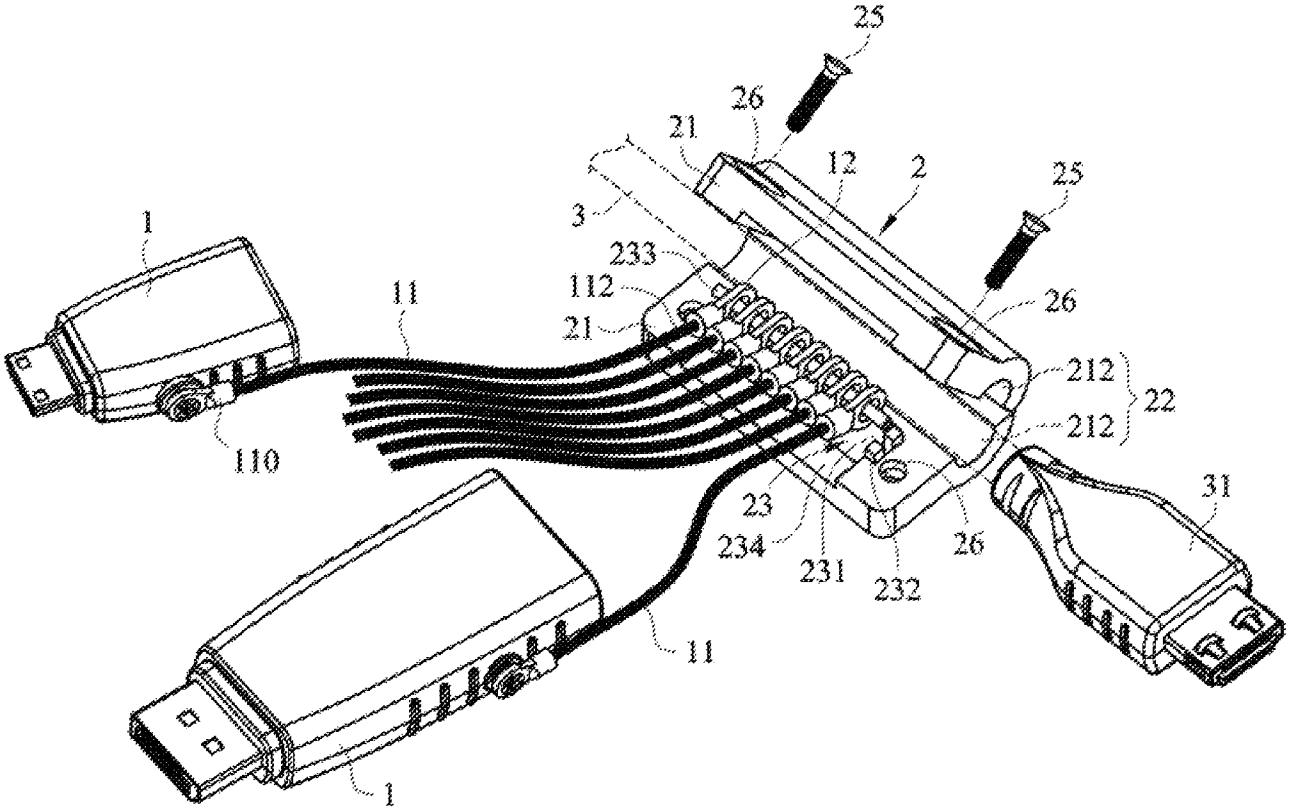
FIG. 1 is a schematic diagram of a loss prevention structure for adapter according to the first embodiment of the present invention.

The purpose, construction, features, functions and advantages of the present invention can be appreciated and understood more thoroughly through the following detailed descriptions with reference to the attached drawings.

In the following, an embodiment is used to describe the various details of the present invention. However, it does not mean that this embodiment represents all the embodiments of the present invention. Other embodiments can be envisaged by people familiar with this field, and thus they all fall into the scope of the present invention.

Refer to FIGS. 1 to 6 respectively for a schematic diagram of a loss prevention structure for adapter according to the first embodiment of the present invention; a schematic diagram of a loss prevention structure for adapter in application according to the first embodiment of the present invention; a schematic diagram of the adapter and the latch lock piece before assembly according to the present invention; a schematic diagram of the assembled latch lock piece and an adapter having cable according to the present invention; a schematic diagram of a loss prevention structure for adapter according to the second embodiment of the present invention; and a schematic diagram of a loss prevention structure for adapter in application according to the second embodiment of the present invention.

As shown in FIGS. 1-6, the present invention provides a loss prevention structure for an adapter, comprising: a plurality of adapters 1, and a latch fastening seat 2.

Wherein, the adapters 1 may be of different specifications, but the present invention is not limited to this. Each adapter 1 has a flexible latch lock piece 11 connected to a side of the adapter 1, the latch lock piece 11 has a movable end 112 and a latch buckle 12 at a tail portion of the latch lock piece 11.

The latch fastening seat 2 is formed by two opposite indent plates 21, and a plurality of connection elements 25. A jacket hole 22 is formed by an indent portion 212 between the two indent plates 21, to hold on to a connection cable 3 or a fixing rod (not shown). In the latch fastening seat 2 is disposed at least a fastening portion 23, and the fastening portion 23 is provided with at least a penetrating portion 24 leading to outside.

When the two indent plates 21 of the latch fastening seat 2 is made to open, that will bring the fastening portion 23 to open accordingly, to allow the adapter 1 and the latch buckle 12 of the latch lock piece 11 to be placed in. When the two indent plates 21 of the a latch fastening seat 2 is made to close, that will bring the fastening portion 23 to close accordingly, to lock and fix the adapter 1 and the latch buckle 12 of the latch lock piece 11 into the fastening portion 23 of the latch fastening seat 2.

As shown in FIGS. 1-6, at least 2 to 4 connection elements 25 are disposed on the latch fastening seat 2, and the connection element 25 is made of a screw. The latch lock piece 11 can be a steel cable. A fixing end 110 is disposed at a connection part of the latch lock piece 11 and the adapter 1. The fixing end 110 is provided with a connection terminal, and the connection terminal is fixed and locked into a screw hole 10 of the adapter 1 by using a connection element 25, but the present invention is not limited to this. A latch buckle 12 is on the other end of the latch lock piece 11, and is made by using a block body or a connection terminal having a screw hole.

Figure 4:
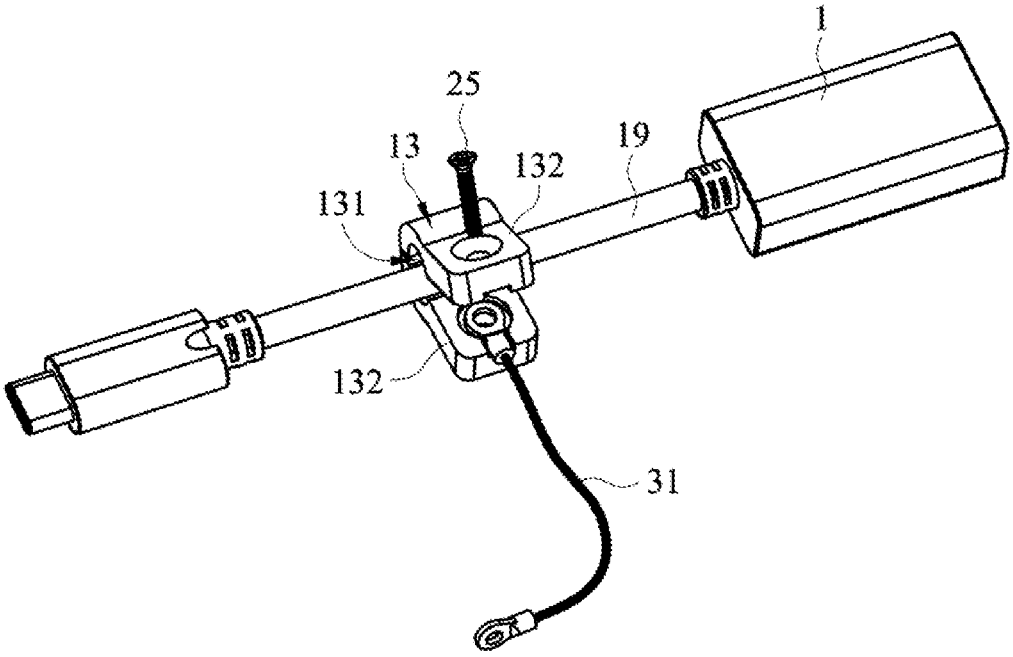
FIG. 4 is a schematic diagram of the assembled latch lock piece and an adapter having cable according to the present invention.

As shown in FIG. 4, a clip hole seat 13 is disposed at the fixing end of the latch lock piece 11, and the clip hole seat 13 is formed by closing two indent plates 132 having holes connected to hems 131, and the connection elements 25. The clip hole seat 13 is used to sleeve around and hold the cable 19 connected to the adapter 1.

Figure 2:
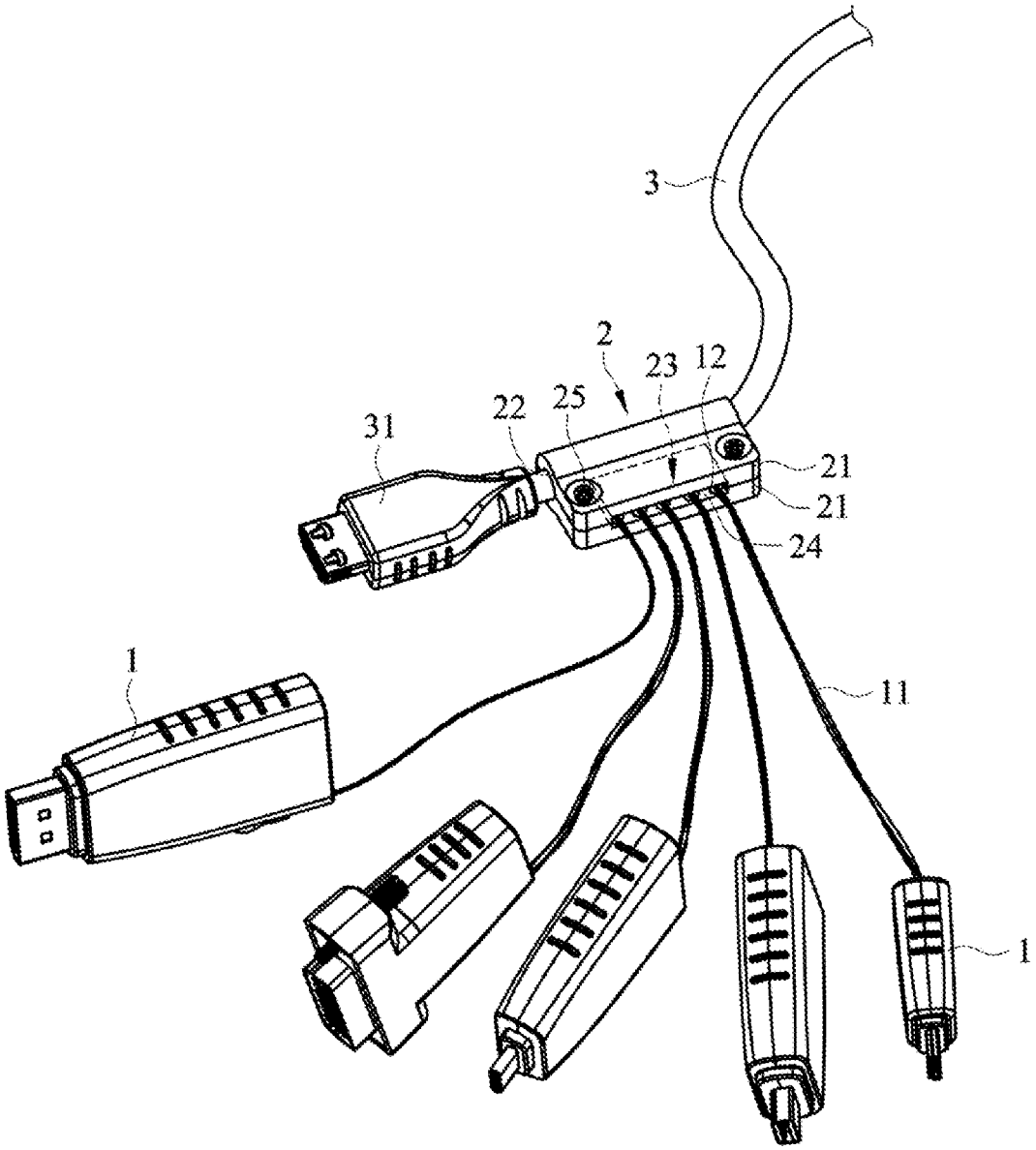
FIG. 2 is a schematic diagram of a loss prevention structure for adapter in application according to the first embodiment of the present invention.
Figure 3:
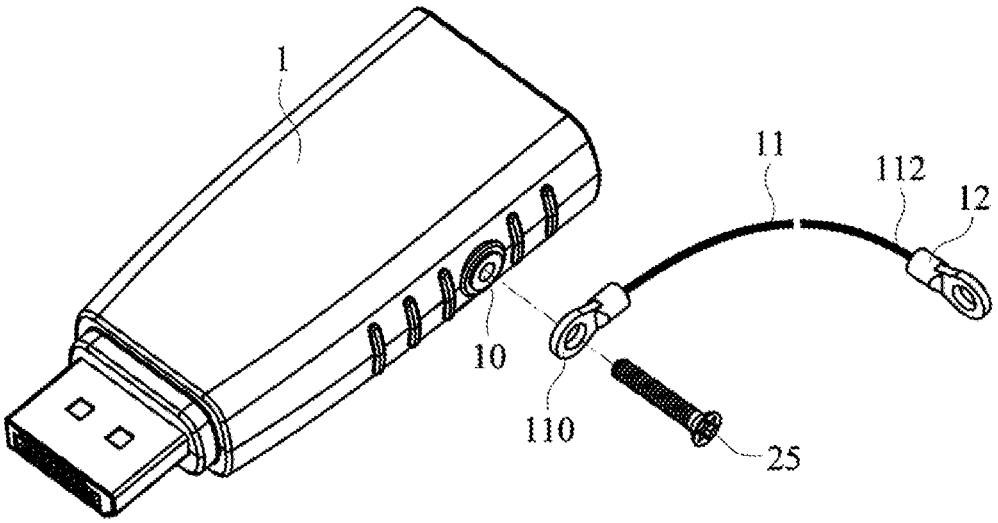
FIG. 3 is a schematic diagram of the adapter and the latch lock piece before assembly according to the present invention.
Figure 6:
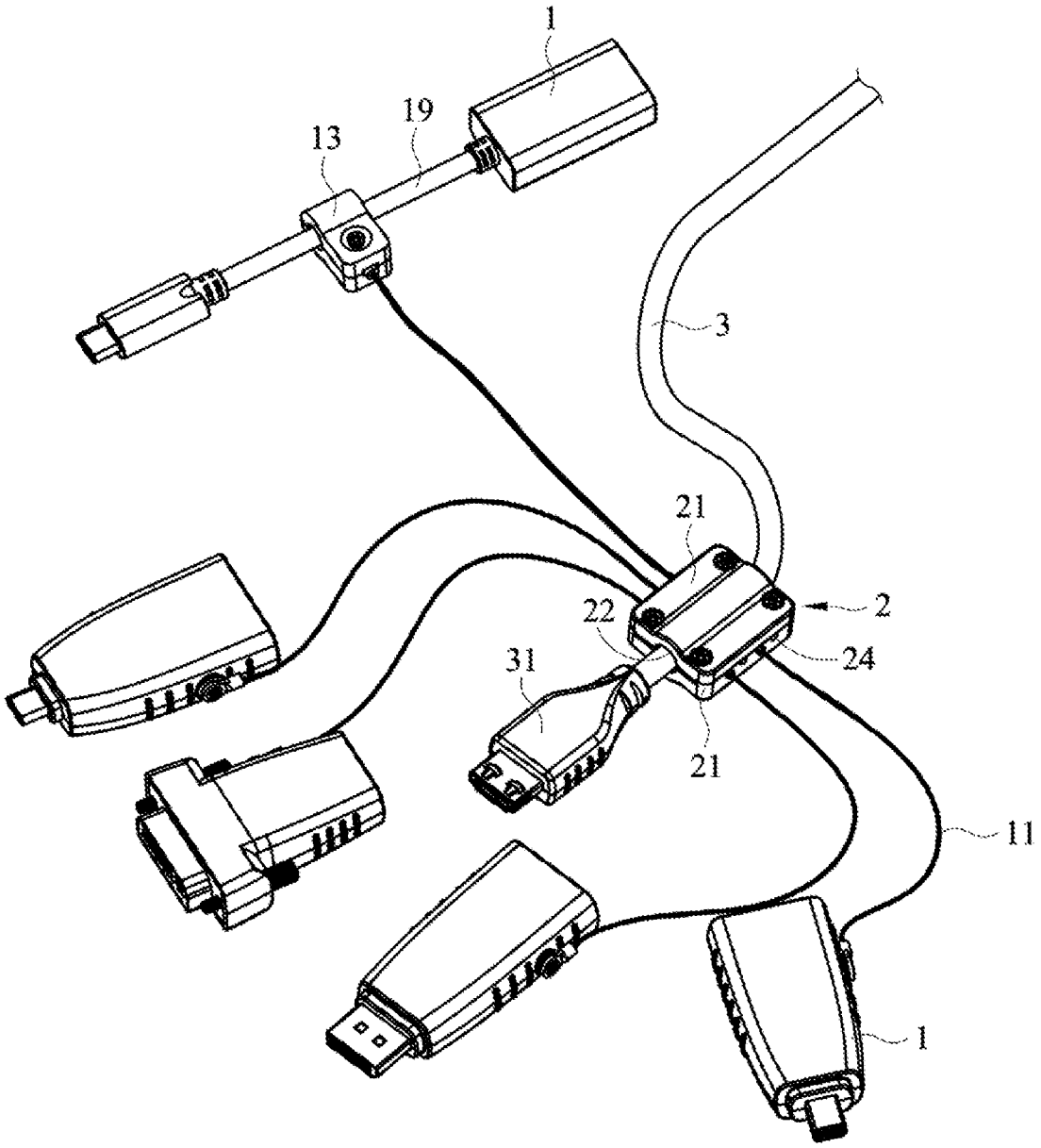
FIG. 6 is a schematic diagram of a loss prevention structure for adapter in application according to the second embodiment of the present invention.

The penetrating portion 24 can be made into a single penetrating hole (as shown in FIG. 2), or a plurality of penetrating holes spaced apart with equal spacing (as shown in FIG. 6), but the present invention is not limited to this.

As shown in FIGS. 1 and 2, on the two indent plates 21 for the latch fastening seat 2 are disposed respectively the hem 20, so that the latch fastening seat 2 can be opened or closed on one side. The fastening portion 23 can be disposed in latch fastening seat 2, on the same side and in a single row.

The latch fastening seat 2 is for example in a shape of a hollow cuboid, the hem 20 is disposed in and connected to the two opposite sides facing each other, and on a rear side of the two indent plates 21, so that the indent plates 21 can be rotated respectively, to make the latch fastening seat 2 open or close. On the left and right sides of the two indent plates 21 are each disposed two screw holes 26, for connecting and fixing the two indent plates 21 by using the connection elements 25.

A jack hole 22 is disposed between the two indent plates 21, to receive and clip the connection cable 3, and on both ends of the connection cable 3 are each disposed a connector 31, but the present invention is not limited to this.

The fastening portion 23 is formed by two rectangular slots 231 inside the two indent plates 21 respectively, and a long side of each slot 231 is disposed a lower step 234 leading to outside, to form a penetrating portion 24 having a penetrating hole.

A cross opening 232 in protrusion is disposed on each of two short sides for the slots 231 of the two indent plates 21, for the lateral rod 233 to put thereon. The lateral rod 233 is used for penetrating through the connection terminals of the latch buckles 12 for the plurality of the latch lock pieces 11, and is locked and fastened in the rectangular fastening portion 23 of the latch fastening seat 2.

Figure 5:
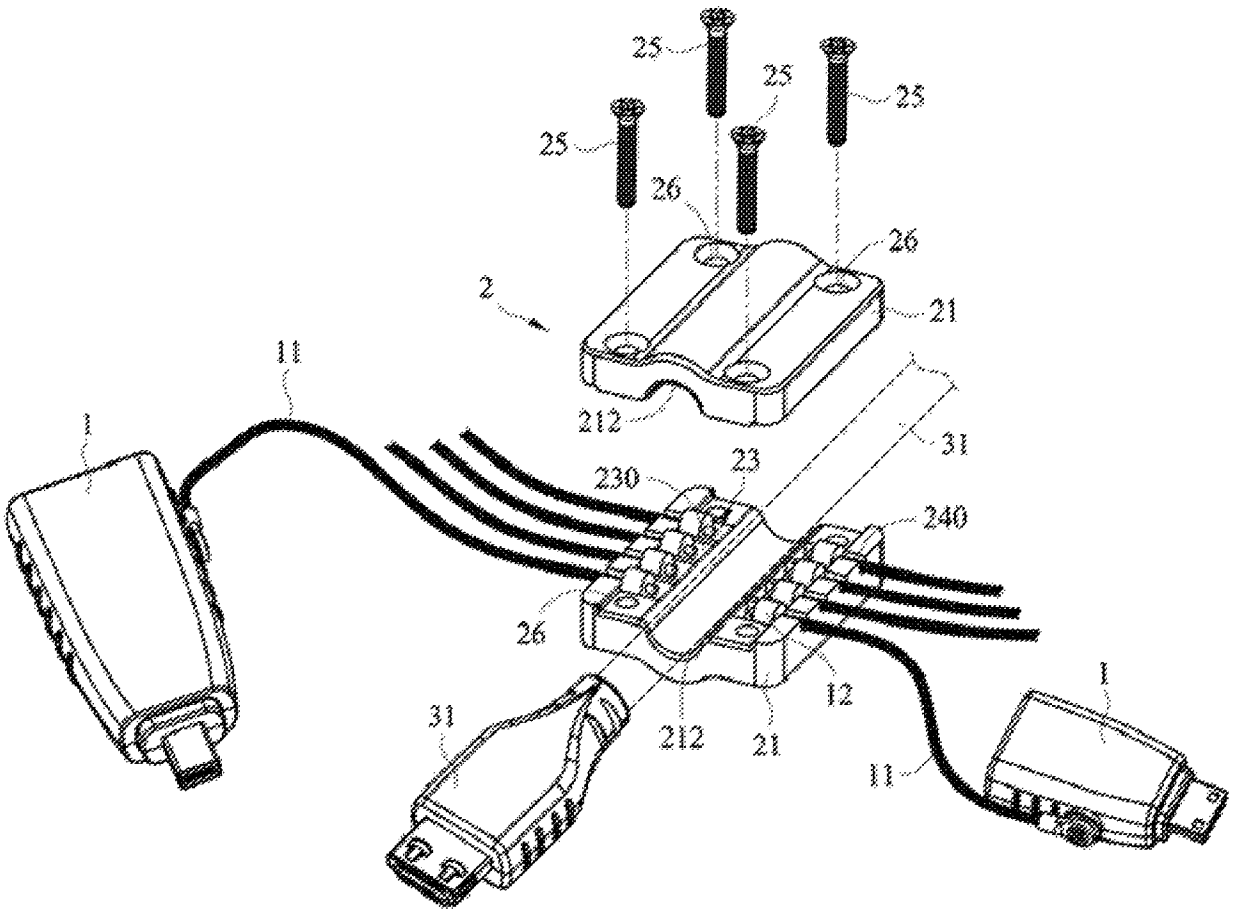
FIG. 5 is a schematic diagram of a loss prevention structure for adapter according to the second embodiment of the present invention.

As shown in FIGS. 5,6, the two indent plates 21 of the latch fastening seat 2 are independent and separate, and can be opened or closed in an up-and-down direction. The fastening portion 23 is disposed in the latch fastening seat 2, on different sides and in two rows.

The latch fastening seat 2 is for example in a shape of a hollow cuboid, the two indent plates 21 are independent and separate. A screw hole 26 is disposed on each of the four corners of the two indent plates 21, for the four connection elements 25 to lock and fix the two indent plates 21.

A jack hole 22 is formed by two indent portions 212 disposed between the two indent plates 21, to receive and clip the connection cable 3, and on both ends of the connection cable 3 are each disposed a connector 31, but the present invention is not limited to this.

The fastening portion 23 is formed by a plurality of indent slots 230 between inner sides of the two indent plates 21. On a side of each indent slot 230 is disposed an indent groove 240 leading to outside, to form the penetrating portion 24 having a plurality of penetrating holes, for the latch buckles 12 of the plurality of the latch lock pieces 11 to put in, to be locked and fixed into the fastening portion 23 for the plurality of indent slots 230 in the latch fastening seat 2.

Compared with the existing technology, the present invention has the advantages that, it can be used to gather and protect the plurality of adapters 1 connected to the latch fastening seat 2, so that the range of movement of the adapters 1 is limited by the length of the latch lock piece 11. In this way, the present invention is able to protect the adapter from being lost, to prevent the latch fastening seat 2 from being opened and the adapters being taken away easily, in achieving the objective of preventing the loss or theft of the adapters 1.

In addition, through the design of the present invention, a plurality of adapters 1 can be attached to the same latch fastening seat 2 to be sold conveniently. As such, the adapters 1 can be replaced by various types of adapters 1 at any time. When the adapter 1 are inserted into the connector 31 connected to the connection cable 3, it could satisfy the needs of the various 3C products. The output of the adapters 1 can be connected to the peripheral equipment of the prevalent technology, such as liquid crystal screen, projector, and stereo surround sound device.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A loss prevention structure for an adapter, comprising:

a plurality of adapters, with each adapter having a flexible latch lock piece connected to a side of the adapter, the latch lock piece has a movable end and a latch buckle at a tail portion of the latch lock piece, wherein the latch lock piece is a steel wire, and the latch buckle is a block body or a connection terminal having a lock hole; and a latch fastening seat, formed by two opposite indent plates, and at least 2 to 4 connection elements, wherein the connection elements are screws, wherein two opposite indent portions between the two indent plates are formed into a jacket hole, to hold on to a connection cable or a fixing rod, in the latch fastening seat is disposed at least a fastening portion, for locking and holding the latch buckle of the latch lock piece, the fastening portion is provided with at least a penetrating portion, for the flexible latch lock piece to penetrate through;

wherein the two opposite sides for the two indent plates of the latch fastening seat are provided with hems connected, so that the latch fastening seat is opened or closed by one side;

wherein the latch fastening seat is in a shape of a hollow cuboid, the hems are disposed and connected on a rear side of the two indent plates, so that the indent plates are adapted to rotate upward or downward, to open or close the latch fastening seat, on the two indent plates are each provided with two screw holes for locking and fixing the two indent plates by using the screws;

a jack hole is disposed between the two indent plates, to receive and clip the connection cable, and on both ends of the connection cable are each disposed a connector;

the fastening portion is formed by two rectangular slots inside the two indent plates respectively, and a long side of each slot is disposed a lower step leading to outside, to form into a penetrating portion having a penetrating hole; and a cross opening in protrusion is disposed on each of two short sides for the slots of the two indent plates, for a lateral rod to put thereon, the lateral rod is used for penetrating through the connection terminals of the latch buckles for the plurality of the latch lock pieces, and is locked and fastened in the fastening portion of the rectangular slot for the latch fastening seat.

2. The loss prevention structure for an adapter as claimed in claim 1, wherein a fixing end is disposed at a connection part of the latch lock piece and the adapter, the fixing end is provided with a connection terminal, and the connection terminal is fixed and locked into a screw hole of the adapter by using a screw.

3. The loss prevention structure for an adapter as claimed in claim 1, wherein the adapter is provided with a cable, the movable end of the latch lock piece is disposed a clip hole seat, and the clip hole seat is formed by closing two indent plates having holes connected to hems, and the connection elements, the cable connected to the adapter is sleeved around and held by the clip hole seat.

4. The loss prevention structure for an adapter as claimed in claim 1, wherein the fastening portion is disposed in a single row on a same side of the latch fastening seat.

5. The loss prevention structure for an adapter as claimed in claim 1, wherein the fastening portion is disposed in double rows on the other side of the latch fastening seat.

6. A loss prevention structure for an adapter, comprising:

a plurality of adapters, with each adapter having a flexible latch lock piece connected to a side of the adapter, the latch lock piece has a movable end and a latch buckle at a tail portion of the latch lock piece, wherein the latch lock piece is a steel wire, and the latch buckle is a block body or a connection terminal having a lock hole; and a latch fastening seat, formed by two opposite indent plates, and at least 2 to 4 connection elements, wherein the connection elements are screws, wherein two opposite indent portions between the two indent plates are formed into a jacket hole, to hold on to a connection cable or a fixing rod, in the latch fastening seat is disposed at least a fastening portion, for locking and holding the latch buckle of the latch lock piece, the fastening portion is provided with at least a penetrating portion, for the flexible latch lock piece to penetrate through;

wherein the two indent plates of the latch fastening seat are independent and separate, and is closed and in an up-down direction;

wherein the latch fastening seat is in a shape of a hollow cuboid, the indent plates are independent and separate, on four corners of the two indent plates are each provided with screw holes, for the screw to fix and lock the two indent plates;

the jack hole is disposed between the two indent plates, to receive and clip the connection cable, and on both ends of the connection cable are each disposed a connector; and the fastening portion is formed by a plurality of indent slots between inner sides of the two indent plates, on a side of each indent slot is disposed an indent groove leading to outside, to form the penetrating portion having a plurality of penetrating holes, for the latch buckles of the plurality of the latch lock pieces to put in, to lock and fix into the fastening portion for the plurality of indent slots of the latch fastening seat.

* * * * *